United States Patent [19]

Charamathieu et al.

[11] Patent Number: 4,986,889

[45] Date of Patent: Jan. 22, 1991

[54] SUCTION CUP FOR THE ELECTROLYTIC TREATMENT OF A SURFACE

[75] Inventors: André Charamathieu, Fontenay Aux Roses; Gérard Gouaillardou, Savigny Sur Orge; Jean-Pierre Cizel, Arpajon, all of France

[73] Assignee: Societe des techniques en Milieu Ionisant STMI, France

[21] Appl. No.: 453,990

[22] Filed: Dec. 20, 1989

[30] Foreign Application Priority Data

Dec. 23, 1988 [FR] France ..... 88 17115

[51] Int. Cl.[5] ..... C25D 17/14

[52] U.S. Cl. ..... 204/279

[58] Field of Search ..... 204/224 R, 224 M, 279, 204/271

[56] References Cited

U.S. PATENT DOCUMENTS

| | | | |
|---|---|---|---|
| 3,294,664 | 12/1966 | Franklin | 204/224 R |
| 3,546,088 | 12/1970 | Barkman et al. | 204/224 R |
| 4,634,511 | 1/1987 | Operschall et al. | 204/224 M |
| 4,750,981 | 6/1988 | Dalland et al. | 204/224 R X |
| 4,810,343 | 3/1989 | Bonnardel | 204/224 R |
| 4,883,576 | 11/1989 | Gemma | 204/224 M |

FOREIGN PATENT DOCUMENTS

| | | |
|---|---|---|
| 0190539 | 8/1986 | European Pat. Off. . |
| 2561672 | 9/1985 | France . |

*Primary Examiner*—Donald R. Valentine

*Attorney, Agent, or Firm*—Michael N. Meller

[57] ABSTRACT

An electrolytic treatment suction cup engaged with a surface (S) to be treated has a cavity subdivided by an electrode (3) into an electrolyte flow chamber (8), an admission chamber (9*a*) and a suction chamber (9*a*), each of the admission and suction chambers being subdividable into a distribution chamber (10) communicating with a pipe connection (12) and a flow equalizing chamber (11) having a channel (14) where the flow is opposite to that (C) in the flow chamber (8) and preferably a channel (15) where the flow is in the same flow direction.

11 Claims, 3 Drawing Sheets

SUCTION CUP FOR THE ELECTROLYTIC TREATMENT OF A SURFACE

DESCRIPTION

The present invention relates to a suction cup or nozzle for the electrolytic treatment of a surface and which can be used in general terms for all treatments involving the circulation or flow of an electrolyte current between the surface and an electrode at a potential different from that of the surface and at a limited distance therefrom, such as electropolishing, electrodecontamination, electropickling, electrodeposition or anode treatment.

It constitutes an improvement to known suction cups (cf. French Pat. No. 2 561 672), which essentially comprise a generally electrically insulating casing and a sealing joint having a closed contour engaged against the surface. The casing is hollow and its cavity contains two chambers defined by the electrode. The electrolyte circulates in the rear admission chamber and then traverses the electrode by holes made in the latter, passes into the front chamber where it is brought into contact with the surface to be treated, which constitutes one wall of said front chamber, and is then sucked in by a duct traversing the casing. The flow is in general terms perpendicular to the surface in the rear admission chamber and the front chamber. However, the flow is not perfectly regular in the front chamber either with respect to speed or direction, due to the geometrical constitution of the cavity, chambers and connections, the flow through the electrode passing through holes or a slot, as shown in FIGS. 1 and 2 of the aforementioned patent. This means that the replenishment of the electrolyte is not uniform over the entire surface to be treated, which leads to heterogeneities of the speed of the treatment. It is therefore impossible to apply high current densities, which would spoil the surface to be treated at the points where the flow is slowest.

The problem of the present invention is to obviate these difficulties by means of an electrolytic treatment suction cup, whose geometrical shape makes it possible to obtain a uniform flow in the flow chamber.

The novel electrolytic treatment suction cup comprises a generally electrically insulating casing, partly defining an electrolyte cavity, the casing being provided with an electrode installed in the cavity, two electrolyte duct connections issuing at two ends of the cavity, a closed contour elastic joint partly defining the cavity and which is to be engaged against the surface, the electrode being located at a uniform distance from the surface and subdividing the cavity into an electrolyte flow chamber between the electrode and the surface, an electrolyte admission chamber between the flow chamber and one of the connections and an electrolyte suction chamber between the flow chamber and the other connection, wherein the electrode is continuous and the admission and suction chambers are in each case constituted by a flow equalizing chamber communicating with the flow chamber by a respective slot, the slots being located on two opposite sides of the flow chamber, the flow equalizing chambers having a channel adjacent to the slot where the electrolyte flows in direction opposite to that of the flow in a the flow chamber, a respective distribution chamber communicating with the connection and flow equalizing chamber, the distribution chambes widening towards the flow equalizing chambers in the extension direction of the slots.

In advantageous embodiments of the invention usable either separately or in combination, the distribution chambers can narrow towards the flow equalizing chambers in a direction perpendicular to the extension direction of the slots and, the flow equalizing chambers can widen towards the distribution chambers in a direction perpendicular to the direction of the slots, and have a part adjacent to the distribution chambers where the electrolyte flows in the same direction as in the flow chamber. The flow equalizing chambers are constituted by a recess adjacent to the distribution chambers and a channel extending between second distribution chambers and the slots.

In general terms, the parts of the suction cup or nozzle and in particular the electrode can be planar or curved as a function of the curvature of the surface to be treated.

The invention is described in greater detail hereinafter relative to non-limitative embodiments and the attached drawings, wherein.

Figure 1:
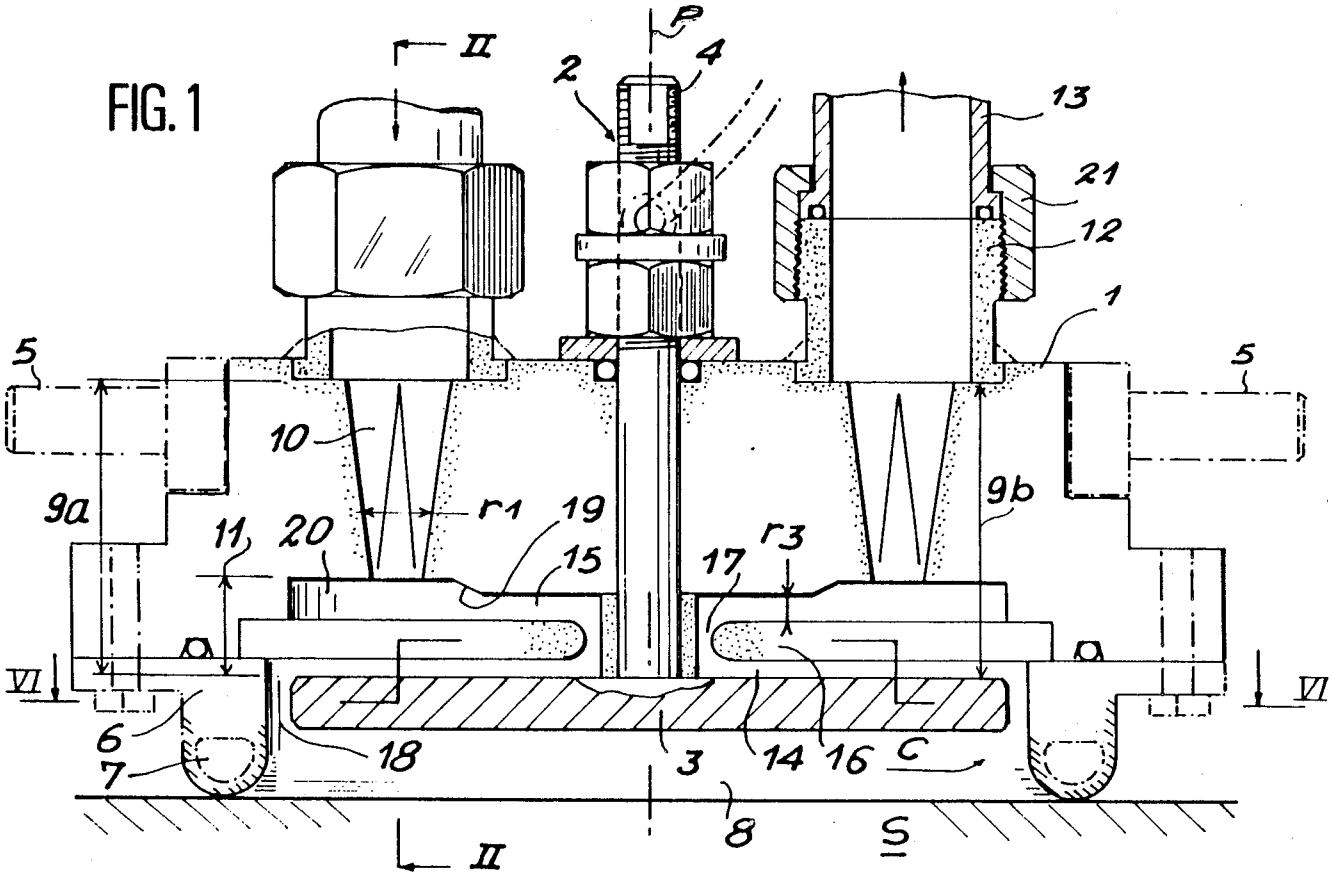
FIG. 1 is a sectional view of the suction cup according to the invention showing the electrolyte flows.

The suction cup or nozzle comprises an electrically insulating material, casing 1, such as a plastics material and is traversed by an electrode 2 terminated by a planar, continuous electrode plate 3. Electrode 2 issues outside casing 1 opposite to the surface S to be supplied with direct current from a cable 4 by a not shown generator and rectifier.

The casing 1 is also provided with means for gripping the suction cup and means for its engagement with surface S, here in the form of opposite appendages 5 and an elastic material closed contour joint 6 applied to the surface S in order to define a tight volume. To this end, joint 6 advantageously comprises an air chamber 7 inflatable in its part adjacent to surface S.

Casing 1 is hollow and defines with joint 6 and surface S a cavity for the circulation or flow of electrolyte which is tight when the suction cup is in the working position. The electrode plate 3 extends within the cavity and defines there an electrolyte flow chamber 8 with surface S. The rest of the cavity forms an admission chamber *9a* and a suction chamber *9b* for the electrolyte, said chambers being similar and symmetrical, in the same way as the rest of the suction cup, with respect to a plane P perpendicular to the surface S and to the plane of FIG. 1. No distinction will be made in the following description between suction and admission chambers *9b*, *9a*.

Each of the chambers can be broken down into a distribution chamber 10 and a circulation or flow equalizing chamber 11. The distribution chamber 10 extends between a connection 12 for a flexible pipe 13 for the admission or suction of the electrolyte and the flow equalizing chamber 11. If C is the flow direction of the electrolyte in flow chamber 8 from slot 18 associated with admission chamber *9a* to that associated with suction chamber *9b*, it is clear that the distribution chamber 10 has a variable rectangular cross-section, whose dimension r1 in a direction parallel to the flow direction C decreases progressively from connection 12 to the flow equalizing chamber 11, whereas its dimension r2 (FIG. 2) increases in the orthogonal direction. This arrangement permits an optimum distribution of the electrolyte from the circular cross-section flexible tube 13 and in a direction perpendicular to the surface S to the flow equalizing chamber 11, where the flow is generally parallel to surface S and whose cross-section is a highly elongated rectangle.

This flow equalizing chamber 11 extends between the distribution chamber 10 and the flow chamber 8. In the construction shown, its shape is relatively complicated and it is possible to distinguish a channel 14 adjacent to the flow chamber 8 and a channel 15 adjacent to the distribution chamber 10. The electrolyte flow takes place parallel to flow direction C, but in the opposite direction in channel 14 and in the same direction in channel 15. This arrangement is obtained by a baffle plate 16 positioned parallel to the plate 3 of electrode 2 and which almost entirely intersects the flow equalizing chamber 11. Channels 14 and 15 communicate by an elongated slot 17 close to the median plane P, whereas the flow equalizing chamber 11 and the flow chamber 8 communicate by another slot 18 defined by plate 3 and joint 6.

Channel 14 adjacent to flow chamber 8 has a uniform cross-section, whereas channel 15 has a cross-section which widens significantly (with regards to the thickness r3 perpendicular to r2) close to the connection with the distribution chamber 10 at the location of an oblique surface 19.

It is possible to see in the flow equalizing chamber 11 a recess 20 between the baffle plate 16 and the casing 1, adjacent to channel 15, which it extends whilst being separated therefrom by the mouth of the distribution chamber 10. This arrangement contributes to the equalizing of the flow.

Figure 6:
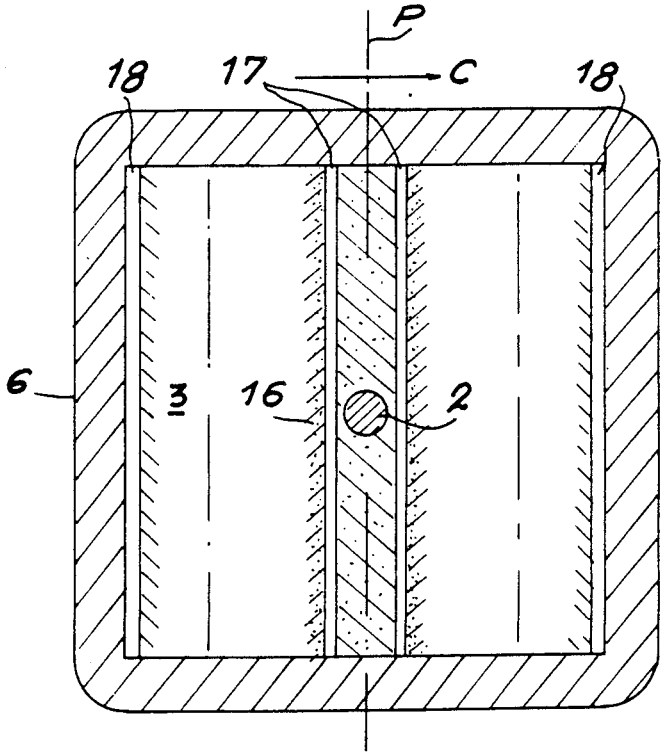
FIG. 6 is a view taken along section VI—VI of FIG. 1.

FIG. 6 more completely shows the construction and in particular the joint 6, which here has a rectangular contour. Slots 17 and 18 are parallel to one another perpendicular to the flow direction C, and parallel to dimension r2 (see FIG. 2) of the distribution chambers 10 up to the edges of joint 6.

In operation, after connecting each of the flexible tubes 13 by means of a respective flange 21 to the connections 12, an electrolyte flow is created, advantageously under an underpressure, at approximately half atmosphere, in order to limit leaks in the case of the hydraulic circuit fracturing. A flow in overpressure or equipressure is also possible. For this pressure value, it is possible to use tubes covered by the trade mark Technopal or those having similar characteristics.

The admission and suction chambers 9*a*, 9*b* of the type described ensure a gradual passage between the flow conditions in tubes 13 and those in the flow chamber 8, so that the flow rate is uniform in the latter both in the direction denoted by C and in the direction perpendicular thereto, more particularly due to the widening of the distribution chambers 10 in accordance with dimension r2. Therefore the replenishment of the electrolyte over the entire treated portion of surface S and circumscribed by joint 6 is ensured, which makes it possible to apply significantly higher current densities without any danger of spoiling or damaging the surface S by modifying the chemical composition of the electrolyte at points where replenishment would be inadequate. Thus, a uniform treatment is ensured.

Figure 2:
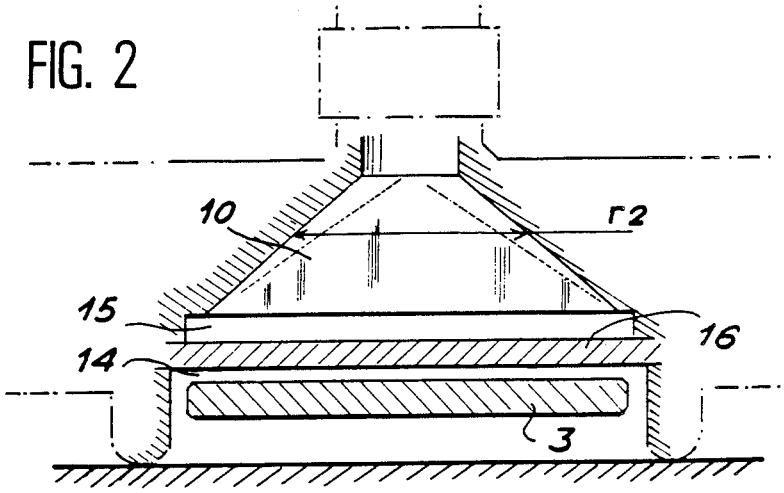
FIG. 2 is a view of the suction cup along section II—II of FIG. 1.
Figure 3:
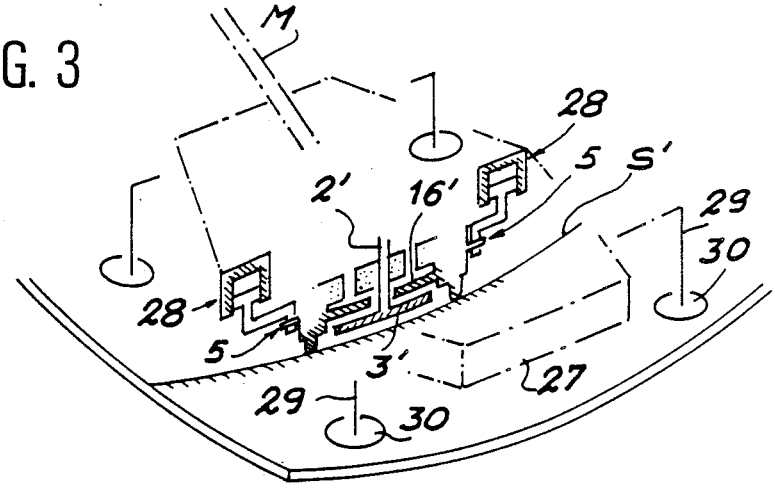
FIG. 3 is a simplified view identical to FIG. 1 and showing a curved construction of the suction cup.

FIG. 3 shows that the suction cup, whose essential parts were planar in FIGS. 1 and 2, can be provided with surfaces S' having a uniform curvature. Electrode 2' then has a curved plate 3' with a radius of curvature which is a consequence thereof. The baffle plates 16' and the walls of the flow equalizing chambers are also curved as a consequence thereof, as is the joint 6. FIG. 3 also shows that the suction cups can be correctly engaged on surface S or S' by a device (described in greater detail in French Pat. No. 2 607 421), formed by a longitudinal frame 27 carrying two jacks 28, the rod of each seizing one of the appendages 5 and the plate on the surface. The frame 27 also carries four lugs 29 at the front, at the rear, to the left and to the right of the suction cup which, via a base 30, engage surface S or S'. The apparatus can then be displaced by a sleeve M, whereof only the end is shown. Engagement can be ensured by any equivalent system and in particular by a teleoperator arm.

Figure 4:
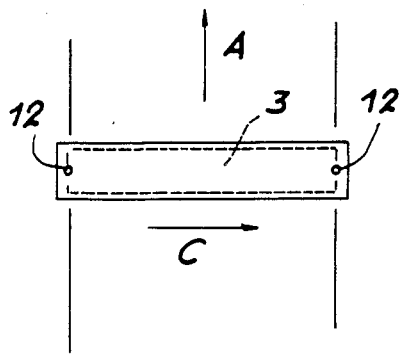
FIG. 4 is a plan view of another construction.
Figure 5:
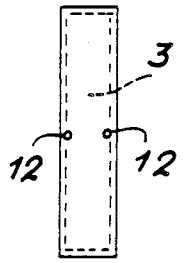
FIG. 5 is a plan view of a further construction.

Whereas the suction cups according to the prior art are generally oval with a limited ellipticity, FIGS. 4 and 5 show that alternately it is possible to construct suction cups according to the invention in the form of very elongated rectangles. FIG. 4 shows a suction cup, which can in particular be used for treating a metal tube or strip 31 moving continuously in a direction A perpendicular to the flow direction of electrolyte C. The suction cup only has a very limited extension in direction A, which is admissible because high current densities, causing rapid working, can be applied without disadvantage. It is also possible to envisage suction cups, whose width is much larger than the length, as shown in FIG. 5, as a result of the flow homogenizing capacities of distribution chambers 10.

Equivalents can be used without passing beyond the scope of the invention.

We claim:

1. A suction cup for the electrolytic treatment of a surface (S) comprising a generally electrically insulating casing (1) partly defining a cavity for holding electrolyte, the casing (1) being adapted for holding an electrode (3) installed in the cavity, said electrode adapted for connection to a current source, two connections (12) for respective electrolyte ducts (13) which communicate with the cavity, a closed contour elastic joint (6) partly defining the cavity and being engaged against the surface, the electrode (3) being located above the surface at a uniform distance therefrom and subdividing the cavity into an electrolyte flow chamber (8) located between the electrode and the surface, an electrolyte admission chamber (9*a*) located between the flow chamber and one of the connections and an electrolyte suction chamber (9*b*) located between the flow chamber and the other connection, wherein the electrode is continuous and the admission and suction chambers each comprise a flow equalizing chamber (11) communicating with the flow chamber by way of a respective first slot (18), the first slots being located on opposite sides of the flow chamber, the flow equalizing chambers each comprising a first channel (14) communicating with the respective first slot (18), in which the electrolyte flows opposite to its flow in the flow chamber (8), and a distribution chamber (10) communicating with the respective connection (12) and the flow equalizing chamber, the dimension of each distribution chamber increasing in a direction in which said first slots extend.

2. The electrolytic treatment suction cup according to claim 1, wherein each of the distribution chambers continuously narrows towards the respective flow equalizing chamber in a direction perpendicular to the extension direction of the first slots.

3. The electrolytic treatment suction cup according to claim 1, wherein each of the flow equalizing chambers widens towards the respective distribution chambers in a direction perpendicular to the extension direction of the first slots.

4. The electrolytic treatment suction cup according to claim 3, wherein each of the flow equalizing chambers comprises a recess (20) adjacent to the respective distribution chamber (10) and a second slot (17) for coupling the first and second channels (14, 15).

5. The electrolytic treatment suction cup according to claim 4, wherein the first and second slots are parallel.

6. The electrolytic treatment suction cup according to claim 5, wherein the first slots (18) are rectilinear and the flow chamber is rectangular.

7. The electrolytic treatment suction cup according to claim 1, wherein each of the flow equalizing chambers (11) comprises a second channel (15) adjacent to the respective distribution chamber (10), in which the electrolyte flows in the same direction as in the flow chamber (8).

8. The electrolytic treatment suction cup according to claim 1, wherein the joint (6) is inflatable.

9. The electrolytic treatment suction cup according to claim 1, wherein said electrode has a planar surface opposing said surface to be electrolytically treated.

10. The electrolytic treatment suction cup according to claim 1, wherein said electrode has a curved surface opposing said surface to be electrolytically treated.

11. The electrolytic treatment suction cup according to claim 1, wherein said electrolyte ducts are aligned in a plane which is substantially parallel to the direction of flow in said flow chamber.

* * * * *